US006499234B2

(12) United States Patent
Manzi

(10) Patent No.: US 6,499,234 B2
(45) Date of Patent: Dec. 31, 2002

(54) SHOE SYSTEM

(76) Inventor: Heather R. Manzi, 6321 - 113th St., Seminole, FL (US) 33772

( * ) Notice: Subject to any disclaimer, the term of this patent is extended or adjusted under 35 U.S.C. 154(b) by 0 days.

(21) Appl. No.: 09/770,425

(22) Filed: Jan. 26, 2001

(65) Prior Publication Data

US 2002/0100189 A1 Aug. 1, 2002

(51) Int. Cl.[7] ..... A43B 3/12; A43B 1/14; A43B 3/24; A43C 13/00

(52) U.S. Cl. ..... 36/100; 36/11.5; 36/15; 36/87

(58) Field of Search ..... 36/100, 101, 11.5, 36/87, 15, 7.5

(56) References Cited

U.S. PATENT DOCUMENTS 2,381,389 A * 8/1945 Riesing ..... 36/11.5
2,421,818 A * 6/1947 Tibiletti ..... 36/11.5
2,495,984 A * 1/1950 Roy ..... 36/101
2,509,335 A * 5/1950 Daadisman ..... 36/11.5
2,590,648 A * 3/1952 Pitz ..... 36/11.5
2,642,677 A * 6/1953 Yates ..... 36/11.5
3,009,269 A * 11/1961 Folk ..... 36/7.5
3,455,037 A * 7/1969 Vlas et al. ..... 36/11.5
4,300,294 A * 11/1981 Riecken ..... 36/101
6,092,308 A * 7/2000 Srourian ..... 36/11.5

* cited by examiner

*Primary Examiner*—Anthony D. Stashick

(57) ABSTRACT

A shoe system with a sole having a top surface and a bottom surface and a generally vertical peripheral side wall therebetween. The sole has a generally horizontal forward region. A plurality of transverse slots extend through holes in the side walls and across the forward region. A strap has opposed ends threaded through the slots for securing a wearer's foot to the sole.

1 Claim, 3 Drawing Sheets

FIG 1
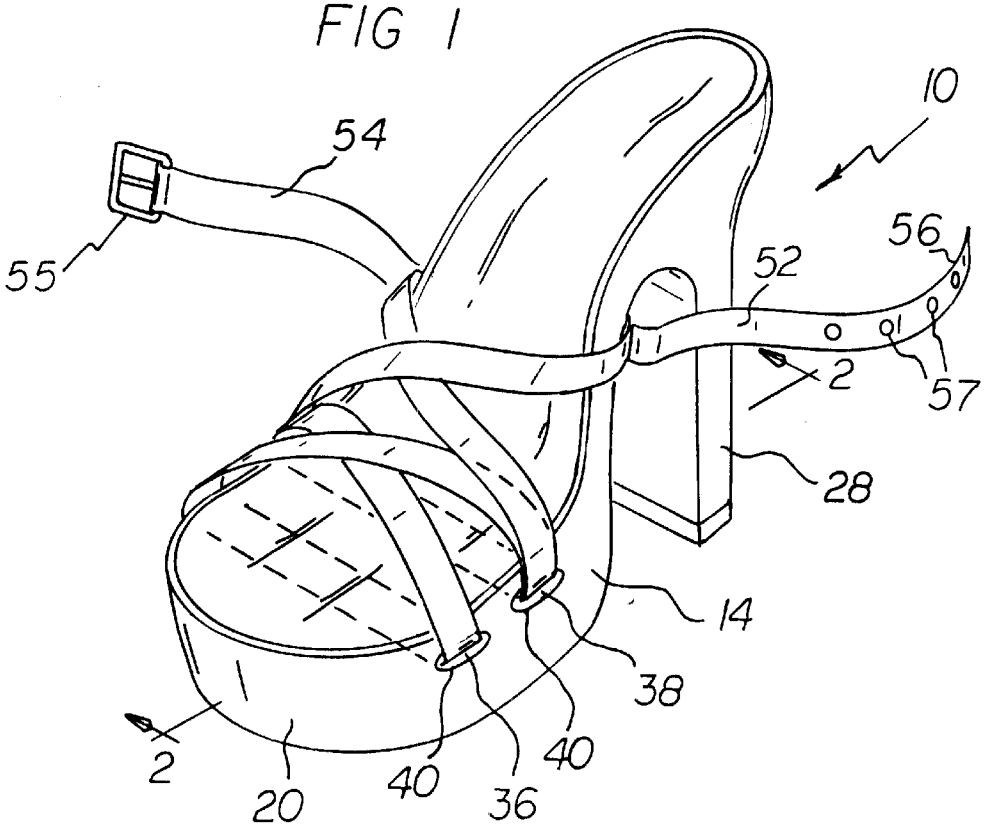
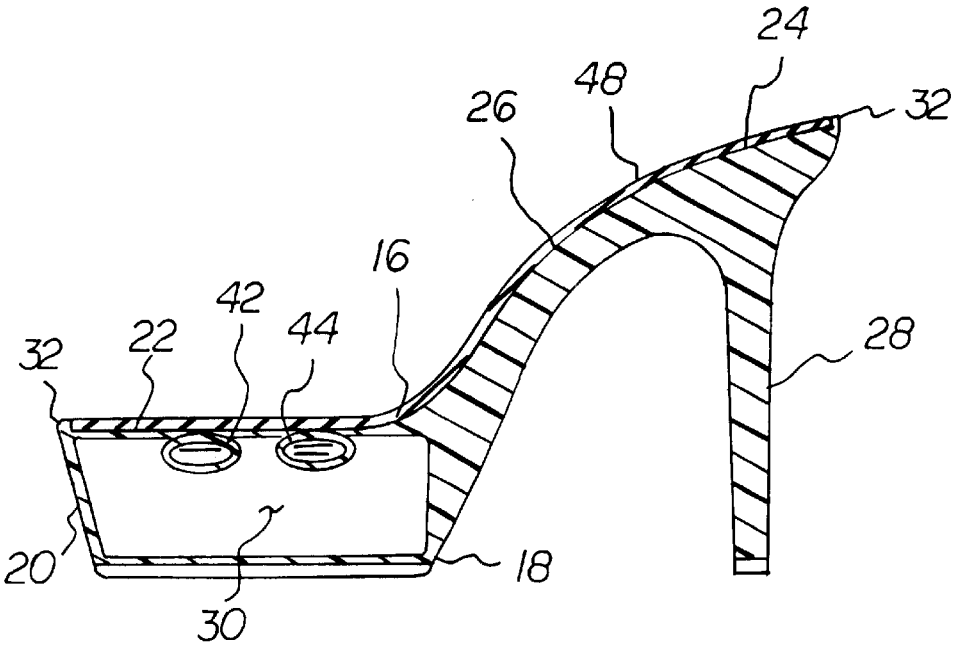
FIG 2

FIG 3
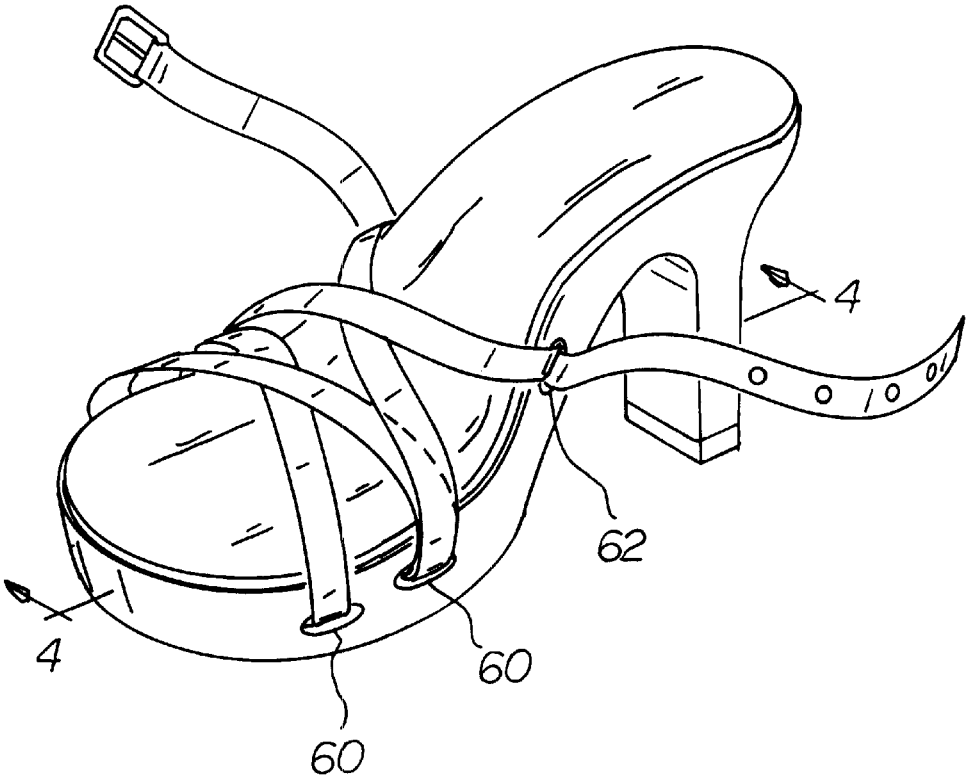
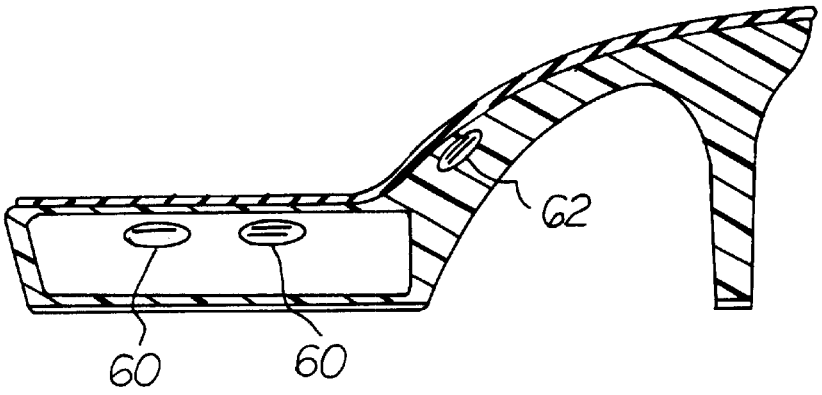
FIG 4

FIG 5
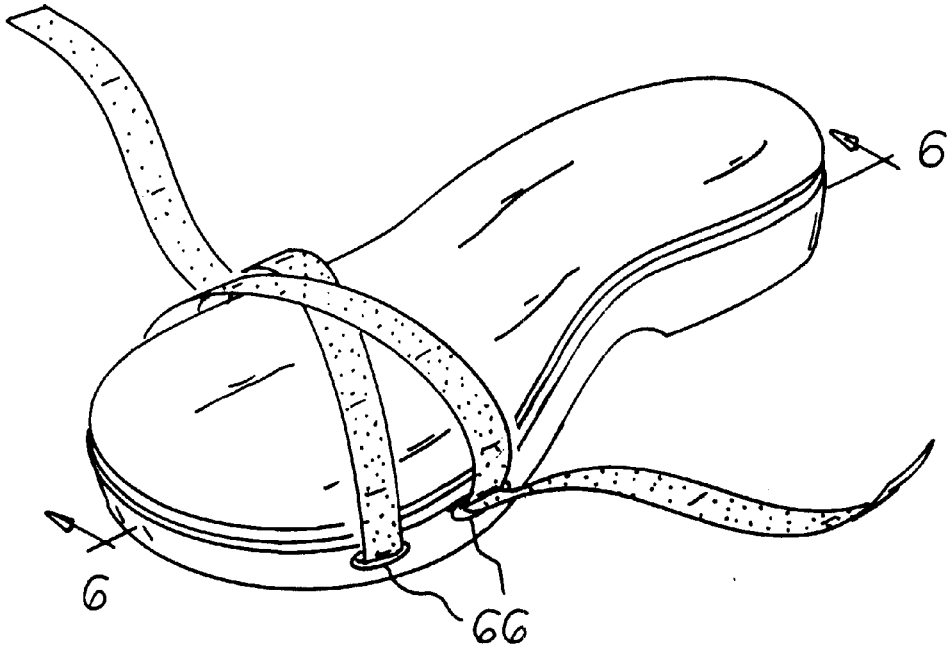
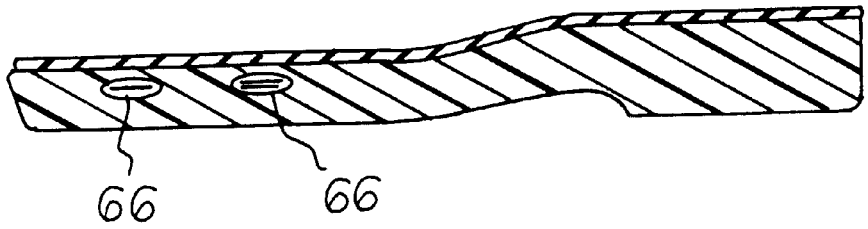
FIG 6

SHOE SYSTEM

BACKGROUND OF THE INVENTION

1. Field of the Invention

The present invention relates to a shoe system and more particularly pertains to providing varied shoe styles for a wearer.

2. Description of the Prior Art

The use of shoes with laces or straps of known designs and configurations is known in the prior art. More specifically, shoes with laces or straps of known designs and configurations previously devised and utilized for the purpose of coupling shoes to the feet of wearers through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U. S. Pat. No. 4,297,798 to Colan a footwear system. U. S. Pat. No. 4,843,736 to Courian discloses a sandal. U. S. Pat. No. 4,300,294 to Riecken discloses a article of footwear. U.S. Pat. No. 4,314,412 to Anderson et al discloses an orthopedic shoe. U. S. Pat. No. 4,200,997 to Sheinhaus et al discloses a sandal. Lastly, U. S. Pat. No. 5,205,054 to York, Jr. discloses an adjustable sandal.

While these devices fulfill their respective, particular objectives and requirements, the aforementioned patents do not describe a shoe system that allows for providing varied shoe styles for a wearer.

In this respect, the shoe system according to the present invention substantially departs from the conventional concepts and designs of the prior art, and in doing so provides an apparatus primarily developed for the purpose of providing varied shoe styles for a wearer.

Therefore, it can be appreciated that there exists a continuing need for a new and improved shoe system which can be used for providing varied shoe styles for a wearer. In this regard, the present invention substantially fulfills this need.

SUMMARY OF THE INVENTION

In view of the foregoing disadvantages inherent in the known types of shoes with laces or straps of known designs and configurations now present in the prior art, the present invention provides an improved shoe system. As such, the general purpose of the present invention, which will be described subsequently in greater detail, is to provide a new and improved shoe system and method which has all the advantages of the prior art and none of the disadvantages.

To attain this, the present invention essentially comprises a sole. The sole has a top surface and a bottom surface. The sole also has a generally vertical peripheral side wall between the top and bottom surfaces. The sole also has a generally horizontal forward region. The forward region is used to support the forward portion of a wearer's foot including the toes. The sole also has a rearward region. The rearward region supports the rearward portion of a wearer's foot including the heel. The sole also has a central region between the forward and rearward regions. The central region supports the central portion of a wearer's foot including the instep. The sole further has a long heel extending downwardly from the rearward region to create a sharply angled central region. The forward region has a hollow zone. The hollow zone has with a top surface and bottom surface.

The hollow zone also has a side surface between the top and bottom surfaces. The top surface has a periphery. An upstanding vertical ledge is provided around the periphery. The entire sole is fabricated of an essentially rigid transparent plastic, preferably an acrylic. The transparent plastic enables light to pass through the various regions. Next provided are two parallel transverse slots. The slots extend through oval holes in the side walls and through the hollow zone of the sole and across the forward region. Two parallel plastic sleeves extend from side wall to side wall defining the slots. A relatively flat soft resilient pad is provided. The pad has a periphery essentially coextensive with the periphery of the top surface. The periphery is adhesively secured to the top surface of the sole. In this manner comfort is provided to a wearer's foot during operation and use. Lastly, a single strap is provided. The single strap has opposed ends. The ends are threaded through the slots for securing a wearer's foot to the pad and sole with the opposed ends wrapping around a wearer's ankle and terminating in a buckle adjacent to the upper extent of a wearer's ankle for securement purposes. The strap is adapted is to be readily removed from, and coupled to, a sole for allowing a wearer to select a particular strap design for a particular occasion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shoe system which has all of the advantages of the prior art shoes with laces or straps of known designs and configurations and none of the disadvantages.

It is another object of the present invention to provide a new and improved shoe system which may be easily and efficiently manufactured and marketed.

It is further object of the present invention to provide a new and improved shoe system which is of durable and reliable constructions.

An even further object of the present invention is to provide a new and improved shoe system which is susceptible of a low cost of manufacture with regard to both materials and labor, and which accordingly is then susceptible of low prices of sale to the consuming public, thereby making such a shoe system economically available to the buying public.

Even still another object of the present invention is to provide a shoe system for providing varied shoe styles for a wearer.

Lastly, it is an object of the present invention to provide a new and improved shoe system with a sole having a top surface and a bottom surface and a generally vertical peripheral side wall therebetween. The sole has a generally horizontal forward region. A plurality of transverse slots extend through holes in the side walls and across the forward region. A strap has opposed ends threaded through the slots for securing a wearer's foot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the primary embodiment of the shoe system, sole and strap, constructed in accordance wit he principles of the present invention.

FIG. 2 is cross sectional view taken along line 2—2 of FIG. 1.

FIG. 3 is perspective illustration of an alternate embodiment of the present invention employing a shorter heal.

FIG. 4 is a ross sectional view taken along line 4—4 of FIG. 3.

FIG. 5 is a perspective illustration of another alternate embodiment of the present invention constructed as a sandal.

FIG. 6 is a cross sectional view taken along line 6—6 of FIG. 5.

The same reference numerals refer to the same parts throughout the various Figures.

DESCRIPTION OF THE PREFERRED EMBODIMENTS

With reference now to the drawings, and in particular to FIG. 1 thereof, the preferred embodiment of the new and improved shoe system embodying the principles and concepts of the present invention and generally designated by the reference numeral 10 will be described.

The present invention, the shoe system 10 is comprised of a plurality of components. Such components in their broadest context include a sole, a plurality of transverse slots, and a single strap. Such components are individually configured and correlated with respect to each other so as to attain the desired objective.

First provided is a sole 14. The sole has a top surface 16 and a bottom surface 18. The sole also has a generally vertical peripheral side wall 20 between the top and bottom surfaces. The sole also has a generally horizontal forward region 22. The forward region is used to support the forward portion of a wearer's foot including the toes. The sole also has a rearward region 24. The rearward region supports the rearward portion of a wearer's foot including the heel. The sole also has a central region 26 between the forward and rearward regions. The central region supports the central portion of a wearer's foot including the instep. The sole further has a long heel 28 extending downwardly from the rearward region to create a sharply angled central region. The forward region has a hollow zone 30. The hollow zone has with a top surface and bottom surface. The hollow zone also has a side surface between the top and bottom surfaces. The top surface has a periphery. An upstanding vertical ledge 32 is provided around the periphery. The entire sole is fabricated of an essentially rigid transparent plastic, preferably an acrylic. The transparent plastic enables light to pass through the various regions.

Next provided are two parallel transverse slots 36, 38. The slots extend through oval holes 40 in the side walls and through the hollow zone of the sole and across the forward region. Two parallel plastic sleeves 42, 44 extend from side wall to side wall defining the slots.

A relatively flat soft resilient pad 48 is provided. The pad has a periphery essentially coextensive with the periphery of the top surface. The periphery is adhesively secured to the top surface of the sole. In this manner comfort is provided to a wearer's foot during operation and use.

Lastly, a single strap 52 is provided. The single strap has opposed ends 54, 56. The ends are threaded through the slots for securing a wearer's foot to the pad and sole with the opposed ends wrapping around a wearer's ankle and terminating in a buckle 55 with associated holes 57 adjacent to the upper extent of a wearer's ankle for securement purposes. The strap is adapted is to be readily removed from, and coupled to, a sole for allowing a wearer to select a particular strap design for a particular occasion.

In an alternate embodiment of the invention the forward region is hollow. In this embodiment, two holes 60 are provided on each side of the forward region. Also, a third slot 62 is provided in the intermediate region. In addition, the sole is of a short high heal type style. Since the tunnels of the primary embodiment are not included in this embodiment, a stiffer strap, as of leather, is preferably utilized.

In still another alternate embodiment of the invention, the slots are apertures 66 extending through the forward region of the sole. In this embodiment, the sole is of a sandal type style. Further, the strap is provided with decorative indicia. Any style strap may thus be used with any of the soles to allow for a change of style by the wearer by simply changing the strap. Lastly, the buckle and holes are eliminated thus allowing the srap ends to be tied in a bow. It should be understood that any of the embodiments could utilize either the buckle or the bow.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe system for providing varied shoe styles for a wearer comprising, in combination:

a sole having a top surface and a bottom surface and a generally vertical peripheral side wall therebetween, the sole having a generally horizontal forward region for supporting the forward portion of a wearer's foot including the toes and a rearward region for supporting the rearward portion of a wearer's foot including the heel and a central intermediate region therebetween for supporting the central portion of a wearer's foot including the instep, the sole having a long heel extending downwardly from the rearward region to create a sharply angled central region, the forward region having a hollow zone with a top surface and bottom surface and a side surface therebetween, the top surface having a periphery therearound, the entire sole being fabricated of an essentially rigid transparent plastic thereby enabling light to pass through the various regions;

two parallel transverse slots extending through holes in the side walls and through the hollow zone of the sole and across the forward region with two parallel plastic sleeves extending from side wall to side wall defining the slots;

one transverse slot extending through a hole in the side walls and through the intermediate region of the sole defining a slot parallel with the two parallel transverse slots;

a relatively flat soft resilient pad having a periphery essentially coextensive with the periphery of the top surface and adhesively secured to the top surface of the sole to comfort a wearer's foot during operation and use; and a single strap having opposed ends threaded through the slots for securing a wearer's foot to the pad and sole with the opposed ends of the strap wrapping around a wearer's ankle and terminating in a buckle adjacent to the upper extent of a wearer's ankle for securement purposes, the strap being readily removed from, and coupled to, a sole for allowing a wearer to select a particular strap design for a particular occasion.

* * * * *